US008580191B2

(12) United States Patent
Xu et al.

(10) Patent No.: US 8,580,191 B2
(45) Date of Patent: Nov. 12, 2013

(54) BRASS ALLOYS HAVING SUPERIOR STRESS CORROSION RESISTANCE AND MANUFACTURING METHOD THEREOF

(75) Inventors: Chuankai Xu, Xiamen (CN); Zhenqing Hu, Xiamen (CN); Siqi Zhang, Xiamen (CN)

(73) Assignee: Xiamen Lota International Co., Ltd., Fujian Province (CN)

( * ) Notice: Subject to any disclaimer, the term of this patent is extended or adjusted under 35 U.S.C. 154(b) by 337 days.

(21) Appl. No.: 12/928,428

(22) Filed: Dec. 9, 2010

(65) Prior Publication Data

US 2011/0132569 A1 Jun. 9, 2011

(30) Foreign Application Priority Data

Dec. 9, 2009 (CN) ..... 2009 1 0252443

(51) Int. Cl.
*C22C 9/00* (2006.01)
*B22D 7/00* (2006.01)
*B22D 11/00* (2006.01)

(52) U.S. Cl.
USPC ..... 420/480; 420/473; 164/476; 164/76.1

(58) Field of Classification Search
USPC ..... 420/469–500; 164/476, 76.1
See application file for complete search history.

(56) References Cited

U.S. PATENT DOCUMENTS 5,653,827 A * 8/1997 Kramer et al. ..... 148/433
7,628,872 B2 * 12/2009 Zhang et al. ..... 148/434
2002/0011288 A1 * 1/2002 Mizoguchi et al. ..... 148/433
2005/0247381 A1 * 11/2005 Oishi ..... 148/434
2006/0201591 A1 * 9/2006 Kawahata et al. ..... 148/553
2009/0016927 A1 * 1/2009 Oishi ..... 420/471

FOREIGN PATENT DOCUMENTS

CN 101 787 461 A 7/2010
EP 2 374 908 A1 10/2011
EP 2 423 339 A1 2/2012
JP 7 310133 A 11/1995
JP 2000239765 A * 9/2000
WO WO 2010/122960 A1 10/2010

OTHER PUBLICATIONS

English abstract of JP-2000239765-A.*
EPO Search Report issued Apr. 6, 2011 for EP Application No. 10193568.2 (6 pages).

* cited by examiner

*Primary Examiner* — Kevin P Kerns
*Assistant Examiner* — Steven Ha
(74) *Attorney, Agent, or Firm* — Christie, Parker & Hale, LLP

(57) ABSTRACT

The present invention relates to a brass alloy having superior stress corrosion comprising: 59.0-64.0 wt % Cu, 0.6-1.2 wt % Fe, 0.6-1.0 wt % Mn, 0.4-1.0 wt % Bi, 0.6-1.4 wt % Sn, at least one element selected from Al, Cr and B, the balance being Zn and unavoidable impurities, wherein the content of Al is 0.1-0.8 wt %, the content of Cr is 0.01-0.1 wt %, the content of B is 0.001-0.02 wt %. The alloy according to the present invention does not contain toxic elements such as lead and antimony, has superior corrosion resistance and good cuttingability and is suitable for the accessories in the potable water supply systems produced by casting, forging and extruding.

12 Claims, 2 Drawing Sheets
(1 of 2 Drawing Sheet(s) Filed in Color)

BRASS ALLOYS HAVING SUPERIOR STRESS CORROSION RESISTANCE AND MANUFACTURING METHOD THEREOF

CROSS-REFERENCE RELATED APPLICATION(S)

This application claims priority to and the benefit of Chinese Patent Application No. 200910252443.9, filed on Dec. 9, 2009, the entire content of which is incorporated herein by reference.

TECHNICAL FIELD OF THE INVENTION

The present invention relates to a brass alloy and manufacturing method thereof, especially to an environment-friendly lead-free free-cutting brass alloy having superior stress corrosion resistance, which is suitable for casting, forging and extruding, and manufacturing method thereof.

BACKGROUND OF THE INVENTION

For a long time, lead brass has been used for the valves such as taps, ball valves and gate valves for water supply. Although the production cost of lead brass is relatively low and the valves assembled with the valves bodies produced therefrom can meet the use requirements, the lead can pollute the environment and is harmful to human health. Accordingly, its use has been increasingly restricted. If such valves are applied for the potable water supply systems, the release of lead into water will be in excess of the safety standard (for example, under NSF/ANSI Standard 61-2007-Drinking Water System Components, the lead into water should not exceed 5 μg/L, and the antimony into water should not exceed 0.6 μg/L).

At present, among all lead-free brass alloys, only the cuttingability of bismuth alloys are closest to that of lead alloys. However, there exist some drawbacks in the process of producing bismuth alloys, for example, poorer weldability, narrower temperature range for forging and slow increase or decrease in temperature required during the heat treatment of ingots or products. After assembling with the valve bodies which are forged with bismuth brass extruded bars supplied by many domestic and overseas copper manufacturers, most of valves will rupture after fuming with 14% ammonia for 24 hours because they can not eliminate the assembly stress by annealing.

The existing lead-free free-cutting antimony brass alloys have good cold and hot formability and superior corrosion resistance properties, but the release of antimony in the products prepared therefrom into water exceeds 0.6 μg/L via testing, and thus such products can not be used for the accessories in the potable water supply systems. Moreover, the valves produced therefrom tend to rupture without eliminating the assembly stress due to the stress corrosion.

Lead-free free-cutting silicon brass is also one of the research focuses in the field of the lead-free copper alloys. Currently researched and developed lead-free free-cutting silicon brasses are mainly high-copper and low-zinc deformation silicon brasses (the zinc content is about 20wt %), the stress corrosion resistance and dezincification corrosion resistance for such brasses are superior. The valves with a large torque of 100-130 N·m still do not occur stress corrosion cracking without eliminating assembly stress even if they are fumed with 14% ammonia for 24 hours. However, such values are lack of marketing competition due to high total production cost caused by high copper content.

The high zinc silicon brass alloys having good cuttability, castability, cold and hot formability and weldability, which are researched and developed by our company, have been applied to bath tap products in large scale and exported to European and American markets. Small scale valves sand casted by such alloys can pass the ammonia fuming test in which the valves are fumed with 14% ammonia for 24 hours without eliminating the assembly stress by annealing. However, when such alloys are used for larger scale valves with an assembly torque of 100-130 N·m, the valves tend to rupture due to the stress corrosion.

SUMMARY OF THE INVENTION

To overcome the rupture problems of the existing lead-free free-cutting brass alloys due to stress corrosion, i.e., the products with a large torque of 100-130 N·m can not pass the stress corrosion test in which the products are fumed with 14% ammonia for 24 hours without eliminating the assembly stress, and can not be used for the potable water supply systems because the releases of the metallic elements exceed the standard. The present invention refers to an environment-friendly lead-free free-cutting brass alloy having superior stress corrosion resistance, good cuttability, castability, cold and hot formability and manufacturing method thereof, especially to an environment-friendly lead-free free-cutting brass alloy having superior stress corrosion resistance, which is suitable for casting, forging and extruding and manufacturing method thereof.

In one aspect, the present invention provides a brass alloy having superior stress corrosion resistance comprising: 59.0-64.0 wt % Cu, 0.6-1.2 wt % Fe, 0.6-1.0 wt % Mn, 0.4-1.0 wt % Bi, 0.6-1.4 wt % Sn, at least one element selected from Al, Cr and B, the balance being Zn and unavoidable impurities, wherein the content of Al is 0.1-0.8 wt %, the content of Cr is 0.01-0.1 wt %, the content of B is 0.001-0.02 wt %.

The content of Fe in the brass alloy preferably is 0.6-1.0 wt %, more preferably is 0.7-0.9 wt %.

The content of Mn in the brass alloy preferably is 0.6-0.9 wt %, more preferably is 0.7-0.9 wt %.

The content of Bi in the brass alloy preferably is 0.5-0.9 wt %, more preferably is 0.5-0.8 wt %.

The content of Sn in the brass alloy preferably is 0.8-1.4 wt %.

The content of Al in the brass alloy preferably is 0.3-0.8 wt %.

The content of Cr in the brass alloy preferably is 0.01-0.03 wt %.

The content of B in the brass alloy preferably is 0.001-0.005 wt %.

In another aspect, the present invention provides a method for manufacturing the above-mentioned brass alloy, which comprises batching, melting, pouring alloy ingots, remelting and sand casting, wherein the temperature for pouring alloy ingots is 990-1040° C., and the temperature for sand casting is 1000-1030° C. According to a preferred embodiment of the present invention, the manufacturing method includes steps as follows. The mid-frequency induction furnace is selected for melting. During the manufacturing processes, first adding a copper ingot and covering agent such as charcoal, adding a zinc ingot in sequence, slagging off, covering, spitting fire and placing for 20 minutes, then adding the intermediate alloys Cu-15 wt % Fe (containing 85% Cu and 15% Fe) and Cu-35 wt % Mn (containing 65 wt % Cu and 35 wt % Mn) as well as bismuth, tin and aluminum in turn, churning homogeneously before adding the intermediate alloys Cu-5 wt % Cr (containing 95% Cu and 5 wt % Cr) and Cu-5 wt % B, refining before slagging off and pouring alloy ingots, then remelting and sand casting to obtain the valves. The intermediate alloys Cu-15 wt % Fe (containing 85% Cu and 15% Fe), Cu-35 wt % Mn (containing 65 wt % Cu and 35 wt % Mn), Cu-5 wt % Cr (95% containing Cu and 5 wt % Cr) and Cu-5 wt % B (containing 95 wt % Cu and 5 wt % B) are respectively used to complement Fe, Mn, Cr and B. Wherein the temperature for pouring alloy ingots is 990-1040° C., and the temperature for sand casting is 1000-1030° C.

In still another aspect, the present invention provides a method for manufacturing the above-mentioned brass alloy, which comprises batching, melting, horizontal continuous casting round ingots, flaying and hot forging, wherein the temperature for horizontal continuous casting round ingots is 990-1040° C., and the temperature for hot forging is 670-740° C. According to a preferred embodiment of the present invention, the manufacturing method includes steps as follows. The mid-frequency induction furnace is selected for melting. During the manufacturing processes, first adding a copper ingot and covering agent such as charcoal, adding a zinc ingot in sequence, slagging off, covering, spitting fire and placing for 20 minutes, then adding the intermediate alloys Cu-15 wt % Fe (containing 85% Cu and 15% Fe) and Cu-35 wt % Mn(containing 65 wt % Cu and 35 wt % Mn) as well as bismuth, tin and aluminum in turn, churning homogeneously before adding the intermediate alloys Cu-5 wt % Cr (containing 95% Cu and 5 wt % Cr) and Cu-5 wt % B (containing 95 wt % Cu and 5 wt % B), refining before slagging off, horizontal continuous casting round ingots with a diameter of 29 mm, intercepting the round ingots before hot forging to obtain the valves. The intermediate alloys Cu-15 wt % Fe (containing 85% Cu and 15% Fe), Cu-35 wt % Mn (containing 65 wt % Cu and 35 wt % Mn), Cu-5 wt % Cr (containing 95% Cu and 5 wt % Cr) and Cu-5 wt % B (containing 95 wt % Cu and 5 wt % B) are respectively used to complement Fe, Mn, Cr and B. The temperature for horizontal continuous casting round ingots is 990-1040° C., and the temperature for hot forging is 670-740° C.

In still yet another aspect, the present invention provides a method for manufacturing the above-mentioned brass alloy, which comprises: batching, melting, horizontal continuous casting round ingots, extruding into bars and hot forging, wherein the temperature for horizontal continuous casting round ingots is 990-1040° C., and the temperature for extruding into bars is 670-740° C. According to a preferred embodiment of the present invention, the manufacturing method includes steps as follows. The mid-frequency induction furnace is selected for melting. During the manufacturing processes, first adding a copper ingot and covering agent such as charcoal, adding a zinc ingot in sequence, slagging off, covering, spitting fire and placing for 20 minutes, then adding the intermediate alloys Cu-15 wt % Fe (containing 85% Cu and 15% Fe) and Cu-35 wt % Mn (containing 65 wt % Cu and 35 wt % Mn) as well as bismuth, tin and aluminum in turn, churning homogeneously before adding the intermediate alloys Cu-5 wt % Cr (containing 95% Cu and 5 wt % Cr) and Cu-5 wt % B (containing 95 wt % Cu and 5 wt % B), refining before slagging off, horizontal continuous casting round ingots with a diameter of 150 mm, then heat extruding into bars with a the diameter of 29 mm, intercepting the round ingots before hot forging to obtain the valves. The intermediate alloys Cu-15 wt % Fe (containing 85% Cu and 15% Fe), Cu-35 wt % Mn (containing 65 wt % Cu and 35 wt % Mn), Cu-5 wt % Cr (containing 95% Cu and 5 wt % Cr) and Cu-5 wt % B (containing 95 wt % Cu and 5 wt % B) are respectively used to complement Fe, Mn, Cr and B. The temperature for horizontal continuous casting round ingots is 990-1040° C., the temperature for extruding into bars is 670-740° C., and the temperature for hot forging is 670-740° C.

The brass alloy according to the present invention containing both Fe and Mn simultaneously has superior stress corrosion resistance over other brass alloys containing only Fe or Mn due to the synergism between Fe and Mn. Furthermore, the cuttability thereof is improved because of the addition of small amounts of Bi. In addition, the brass alloy according to the present invention does not contain the toxic elements such as lead. Accordingly, the alloy according to the present invention is an environment-friendly lead-free free-cutting brass alloy having superior stress corrosion resistance.

The valves with a large assembly torque (above 100N·m) produced with the brass alloy according to the present invention do not rupture under the conditions of unannealing and ammonia fuming with 14% ammonia medium which is much higher than the national and ISO standard. This is a significant breakthrough when compared with other brass alloys. Therefore, the valves and taps produced with the alloy according to the present invention can be supplied for various complex environments.

BRIEF DESCRIPTION OF DRAWINGS

The patent or application file contains at least one drawing executed in color. Copies of this patent or patent application publication with color drawing(s) will be provided by the Office upon request and payment of the necessary fee.

The accompanying drawings, together with the specification, illustrate exemplary embodiments of the present invention, and, together with the description, serve to explain the principles of the present invention.

DETAILED DESCRIPTION OF THE INVENTION

Figure 1:
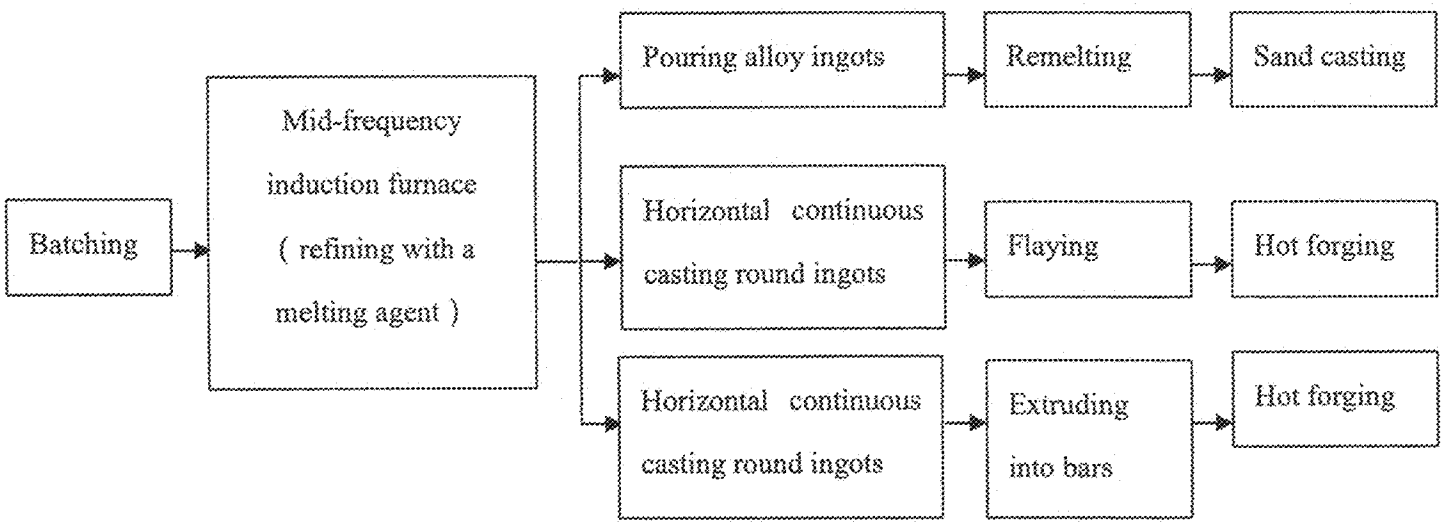
FIG. 1 is a flow chart for manufacturing the brass alloy according to the present invention.
Figure 2:
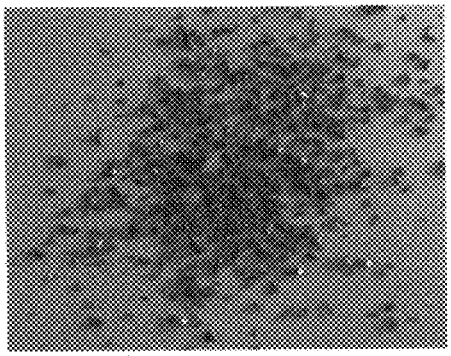
FIG. 2 is the cutting morphology of Alloy 1 according to the present invention.
Figure 3:
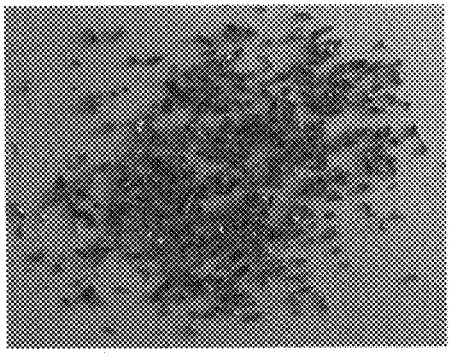
FIG. 3 is the cutting morphology of Alloy 4 according to the present invention.
Figure 4:
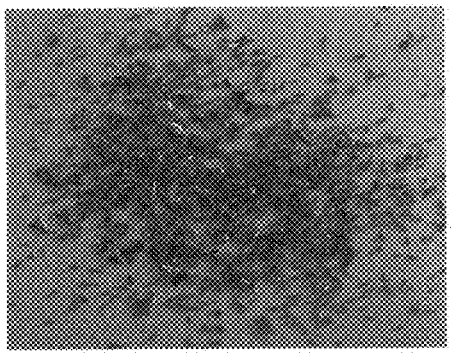
FIG. 4 is the cutting morphology of Alloy 6 according to the present invention.
Figure 5:
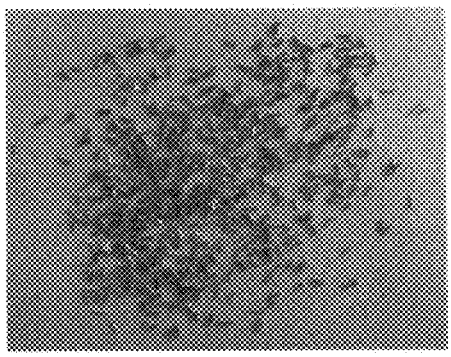
FIG. 5 is the cutting morphology of C36000 alloy.

In order that the present invention may be more fully understood, it will now be described detailedly as follows.

To solve the existing technical problems, the present invention provides an environment-friendly lead-free free-cutting brass alloy having superior stress corrosion resistance, comprising: 59.0-64.0 wt % Cu, 0.6-1.2 wt % Fe, 0.6-1.0 wt % Mn, 0.4-1.0 wt % Bi, 0.6-1.4 wt % Sn, at least one element selected from Al, Cr and B, the balance being Zn and unavoidable impurities, wherein the content of Al is 0.1-0.8 wt %, the content of Cr is 0.01-0.1 wt % and the content of B is 0.001-0.02 wt %.

The solid solubility of iron in copper is extremely low. The iron is present in the form of iron-rich phase upon exceeding the solid solubility. Such iron-rich phase having high melting point may both fine the ingot structure and inhibit the grain growth, thereby enhancing the mechanical properties and processabilily of the brass alloys. In the alloy according to the present invention, the content of iron is limited in the range of 0.6-1.2 wt %. When the content of iron is too low, the effect is not obvious. When the content is too high, the segregation of the iron-rich phase will occur, thereby decreasing the corrosion resistance and affecting the surface quality of the products made therefrom.

The addition of manganese into alloys can produce the solid solution strengthening effect and improve the corrosion resistance of the alloys, especially in the seawater and superheated steam, but the copper-based alloys containing manganese tend to rupture due to stress corrosion. In the alloy according to the present invention, the content of manganese is limited in the range of 0.6-1.0 wt %. When the manganese content is low than 0.6 wt %, the corrosion resistance of the alloys will be not so good. When the manganese content is higher than 1.0 wt %, the tendency to rupture will increase due to stress corrosion.

The simultaneous addition of both iron and manganese into brasses can remarkably improve the corrosion resistance, in particular the stress corrosion resistance. Specifically, because of the simultaneous addition of both iron and manganese into brasses, on the one hand, the manganese inhibits the segregation of iron and eliminates the disadvantages caused by iron, on the other hand, the synergism between Fe and Mn is particularly benefit to the stress corrosion resistance of the brasses.

In the alloy according to the present invention, the addition of bismuth is to ensure excellent cuttability. The content of bismuth is limited in the range of 0.4-1.0 wt %. When the content of bismuth is low than 0.4 wt %, it is difficult to meet the requirements on cuttability in the practice. When the content is higher than 1.0 wt %, the cost of the raw materials will increase.

The main functions of tin are to change the distribution of bismuth in the alloy, decrease the hot-short and cold-short trends of the brass alloys containing bismuth, facilitate the cold and hot formability of the alloy and further improve the corrosion resistance of the alloy. The content of tin is limited in the range of 0.6-1.4 wt %, higher tin content will increase the cost of the raw materials and decrease the mechanical properties of the alloy.

The compact protective film on the alloy surface was attributed to the addition of aluminum, which can improve the stress corrosion resistance of the alloy and enhance the fluidity of the alloy, thereby facilitating the cast moulding. The highest aluminum content is 0.8 wt %. When the aluminum content is too high, the oxidized sediments will form, adversely decreasing the fluidity of the alloy and is disadvantageous to the moulding of casts and ingots.

The objective of selectively adding chromium and boron is to fine grains. Chromium also has a strengthening effect on the alloy. The content thereof should be limited below 0.1 wt %. Although the solid solubility of boron in copper is quite low and decreases with the decrease in temperature, the precipitated boron is also able to improve the cuttability. The additional amount of boron preferably does not exceed 0.02 wt %. When the boron content is too high, the alloy will become brittle.

The present invention provides a method for manufacturing the above-mentioned brass alloy, which comprises: batching, melting, pouring alloy ingots, remelting and sand casting, wherein the temperature for pouring alloy ingots is 990-1040° C. and the temperature for sand casting is 1000-1030° C.

The present invention provides another method for manufacturing the above-mentioned brass alloy, which comprises: batching, melting, horizontal continuous casting round ingots, flaying and hot forging, wherein the temperature for horizontal continuous casting round ingots is 990-1040° C. and the temperature for hot forging is 670-740° C.

The present invention provides still another method for manufacturing the above-mentioned brass alloy, which comprises: batching, melting, horizontal continuous casting round ingots, extruding into bars and hot forging, wherein the temperature for horizontal continuous casting round ingots is 990-1040° C., the temperature for extruding into bars is 670-740° C. and the temperature for hot forging is 670-740° C.

The process flow chart of manufacturing the above-mentioned brass alloy according to the present invention is shown in FIG. 1.

When compared to the prior art, the present invention has the following advantages:

The brass alloy according to the present invention has superior corrosion resistance, especially stress corrosion resistance due to the simultaneous addition of both iron and manganese. It has been demonstrated by the experiments that the brass alloy according to the present invention does not rupture under the conditions of eliminating the assembly stress without annealing and ammonia fuming with 14% ammonia medium for 24 hours which is much higher than the national and ISO standard.

The brass alloy according to the present invention being an environment-friendly alloy does not contain the toxic elements such as lead and antimony, and the precipitated amount of the alloying elements into water meets the NSF/ANSI61-2007 standard.

The addition of bismuth in the present invention ensures the cuttability of the alloy, and meets the requirements on cuttability in the practice.

The present invention uses horizontal continuous casting ingots to hot forge directly valves instead of the commonly used extruding into bars, thereby decreasing the production cost.

The brass alloy according to the present invention has good use performance (such as corrosion resistance and mechanical properties) and processability (such as cuttability, castability, cold and hot formability and weldability), and is especially suitable for the accessories in the potable water supply systems (such as taps and various valves) produced by casting, forging and extrusion.

DETAILED DESCRIPTION OF PREFERRED EMBODIMENTS

Various example embodiments of the present invention will now be described more fully with reference to the accompanying drawings.

EXAMPLES

The composition of the brass alloys according to the present invention and the alloys for comparative study are listed in table 1, wherein Alloys 1-4 are produced by pouring alloy ingots, remelting and sand casting, the manufacturing method includes steps as follows. The mid-frequency induction furnace is selected for melting. During the manufacturing processes, first adding a copper ingot and covering agent such as charcoal, adding a zinc ingot in sequence, slagging off, covering, spitting fire and placing for 20 minutes, then adding other raw materials according to the composition shown in table 1, wherein the raw materials are selected from Cu-15 wt % Fe immediate alloy, Cu-35 wt % Mn immediate alloy, bismuth, tin, aluminum, Cu-5 wt % Cr immediate alloy and Cu-5 wt % B immediate alloy, refining before slagging off and pouring alloy ingots, then remelting and sand casting to obtain the valve. The temperature for pouring alloy ingots is 990-1040° C., and the temperature for sand casting is 1000-1030° C.

Alloys 5-7 are produced by horizontal continuous casting round ingots and hot forge moulding, the manufacturing method includes steps as follows. The mid-frequency induction furnace is selected for melting. During the manufacturing processes, first adding a copper ingot and covering agent such as charcoal, adding a zinc ingot in sequence, slagging off, covering, spitting fire and placing for 20 minutes, then adding other raw materials according to the composition shown in table 1, wherein the raw materials are selected from Cu-15 wt % Fe immediate alloy, Cu-35 wt % Mn immediate alloy, bismuth, tin, aluminum, Cu-5 wt % Cr immediate alloy and Cu-5 wt % B immediate alloy, refining before slagging off, horizontal continuous casting round ingots with a diameter of 29 mm, intercepting the round ingots before hot forging to obtain the valves.

The temperature for horizontal continuous casting round ingots is 990-1040° C., and the temperature for hot forging is 670-740° C.

Alloys 8-10 are produced by the horizontal continuous casting round ingots and extruding into bars before hot forging moulding, and the manufacturing method includes steps as follows. The mid-frequency induction furnace is selected for melting. During the manufacturing processes, first adding a copper ingot and covering agent such as charcoal, adding a zinc ingot in sequence, slagging off, covering, spitting fire and placing for 20 minutes, then adding other raw materials according to the composition shown in table 1, wherein the raw materials are selected from Cu-15 wt % Fe immediate alloy, Cu-35 wt % Mn immediate alloy, bismuth, tin, aluminum, Cu-5 wt % Cr immediate alloy and Cu-5 wt % B immediate alloy, refining before slagging off, horizontal continuous casting round ingots with a diameter of 150 mm, then heat extruding into bars with a diameter of 29 mm, intercepting the round ingots before hot forging to obtain the valves. The temperature for horizontal continuous casting round ingots is 990-1040° C., the temperature for extruding into bars is 670-740° C. and the temperature for hot forging is 670-740° C.

The immediate alloys Cu-15% Fe, Cu-35 wt % Mn, Cu-5 wt % Cr and Cu-5 wt % B described above are used to complement Fe, Mn, Cr and B respectively.

The immediate alloys Cu-15% Fe (containing Cu 85 wt % and Fe 15 wt %) and Cu-5 wt % B (containing Cu 95 wt % and B 5 wt %) are obtained from Jinan Xinhaitong Special Alloy Co., Ltd. (China). The immediate alloys Cu-5 wt % Cr (containing Cu 95 wt % and Cr 5 wt %) and Cu-35 wt % Mn (containing Cu 65 wt % and Mn 35 wt %) are obtained from Shandong Shanda Al & Mg Melt Technology Co., Ltd. (China).

Alloy 9 or 10 is the alloy which only contains Fe or Mn.

Alloy ZCuZn40Pb2: a lead brass, obtained from Zhejiang Keyu Metal Materials Co., Ltd. (China).

Alloy C36000: ϕ29, a lead brass, semi-hardness, obtained from Zhejiang Keyu Metal Material s Co., Ltd. (China).

Alloy C87850: a silicon brass, obtained from Japan Sanbao Copper and Brass Company.

The alloy composition in the test samples (wt %)

| Alloys | Cu | Fe | Mn | Sn | Bi | Al | Cr | B | Pb | Si | Zn |
|---|---|---|---|---|---|---|---|---|---|---|---|
| 1 | 61.51 | 0.63 | 0.65 | 0.99 | 0.62 | 0.20 | — | 0.0015 | — | — | Balance |
| 2 | 60.95 | 0.75 | 0.72 | 1.30 | 0.54 | — | 0.03 | 0.0013 | — | — | Balance |
| 3 | 62.72 | 0.81 | 0.70 | 1.20 | 0.81 | 0.63 | — | 0.005 | — | — | Balance |
| 4 | 62.34 | 0.77 | 0.80 | 1.32 | 0.86 | 0.39 | — | 0.001 | — | — | Balance |
| 5 | 61.53 | 1.02 | 0.85 | 0.96 | 0.74 | — | 0.01 | — | — | — | Balance |
| 6 | 63.09 | 0.62 | 0.62 | 0.75 | 0.66 | 0.30 | — | 0.002 | — | — | Balance |
| 7 | 62.52 | 0.84 | 0.91 | 1.34 | 0.57 | 0.48 | — | — | — | — | Balance |
| 8 | 61.94 | 0.75 | 0.82 | 1.26 | 0.49 | 0.28 | — | — | — | — | Balance |
| 9 | 61.30 | 0.92 | — | 1.21 | 0.51 | 0.37 | — | — | — | — | Balance |
| 10 | 60.84 | — | 0.95 | 1.14 | 0.62 | 0.29 | 0.02 | 0.004 | — | — | Balance |
| ZCuZn40Pb2 | 60.57 | 0.02 | — | — | — | 0.53 | — | — | 2.05 | — | Balance |
| C36000 | 61.53 | 0.08 | — | — | — | — | — | — | 2.98 | — | Balance |
| C87850 | 76.34 | 0.03 | — | — | — | — | — | — | 0.01 | 2.95 | Balance |

The property testing of the alloys listed above are performed below. The testing results are as follows:

1. Castability

The castability of the alloys listed in table 1 is measured by four kinds of common standard test samples for casting alloys. Volume shrinkage test samples are used for measuring the concentrating shrinkage cavity, dispersing shrinkage cavity and shrinkage porosity. Spiral samples are used for measuring the melt fluid length and evaluating the fluidity of the alloy. Strip samples are used for measuring linear shrinkage rate and bending resistance (bending angle) of the alloys. Circular samples with different thicknesses are used for measuring shrinkage crack resistance of the alloys. If the face of the concentrating shrinkage cavity for volume shrinkage test samples is smooth, there is no visible shrinkage porosity in the bottom of the concentrating shrinkage cavity, and there is no visible dispersing shrinkage cavity in the test samples' cross section, it indicates the castability is excellent, and will be shown as "○". If the face of the concentrating shrinkage cavity is smooth but the height of visible shrinkage porosity is less than 5 mm in depth, it indicates castability is good, and will be shown as "Δ". If the face of the concentrating shrinkage cavity is not smooth and the height of visible shrinkage porosity is more than 5 mm in depth, it will be shown as "×". If there is visible crack in the casting face or the polishing face of the test samples, it is rated as poor, and will be shown as "×", and if there is no crack, it is rated as excellent, and will be shown as "○". The results are shown in table 2.

TABLE 2

Castability of the test samples

| Alloys | 1 | 2 | 3 | 4 | ZCuZn40Pb2 | C87850 |
|---|---|---|---|---|---|---|
| Volume shrinkage | ○ | ○ | ○ | ○ | ○ | Δ |
| Fluid length/mm | 390-410 | | | 415 | 400 | 405 |
| Linear shrinkage/% | 1.6-1.9 | | | | 2.1 | 1.9 |
| Bending angle/° | 70 | 75 | 60 | 85 | 70 | 90 |
| Circular 2.0 mm | ○ | ○ | ○ | ○ | ○ | ○ |

TABLE 2-continued

| Castability of the test samples | | | | | | | |
|---|---|---|---|---|---|---|---|
| Alloys | | 1 | 2 | 3 | 4 | ZCuZn40Pb2 | C87850 |
| samples | 3.5 mm | ○ | ○ | ○ | ○ | ○ | ○ |
| | 4.0 mm | ○ | ○ | ○ | ○ | ○ | ○ |
| Hardness (HRB) | | 60-75 | | | | 63 | 80 |

2. Forgeability

A test sample with a length (height) of 25 mm was cut from a horizontal continuous casting round ingot with a diameter of 29 mm or from a extruded bar, and pressure deformed by hot pressing under the temperatures of 680° C. and 730° C. to evaluate the hot forgeability of the test sample. The hot forgeability of the test sample was evaluated by occurrence of cracks while changing the upset ratio given below.

Upset ratio (%)=[(40−$h$)/40]×100($h$: height after pressure deformation)

If the face of the test sample is smooth and glossiness, and there is no visible crack, it indicates the forgeability is excellent, and will be shown as "○". If the face of the test sample is rough, and there is no visible crack, it indicates the forgeability is good, and will be shown as "Δ". If there is visible crack, it is rated as poor, and will be shown as "×". The results are shown in table 3.

TABLE 3

| Forgeability of the test samples | | | | | | | | | | | | |
|---|---|---|---|---|---|---|---|---|---|---|---|---|
| | Hot forgeability | | | | | | | | | | | |
| | Upset ratio (%, 680° C.) | | | | | | Upset ratio (%, 730° C.) | | | | | |
| Alloys | 40 | 50 | 60 | 70 | 80 | 90 | 40 | 50 | 60 | 70 | 80 | 90 |
| 5 | ○ | ○ | ○ | Δ | Δ | x | ○ | ○ | ○ | ○ | Δ | x |
| 6 | ○ | ○ | ○ | Δ | x | x | ○ | ○ | ○ | Δ | Δ | x |

TABLE 3-continued

| Forgeability of the test samples | | | | | | | | | | | | |
|---|---|---|---|---|---|---|---|---|---|---|---|---|
| | Hot forgeability | | | | | | | | | | | |
| | Upset ratio (%, 680° C.) | | | | | | Upset ratio (%, 730° C.) | | | | | |
| Alloys | 40 | 50 | 60 | 70 | 80 | 90 | 40 | 50 | 60 | 70 | 80 | 90 |
| 7 | ○ | ○ | ○ | ○ | Δ | x | ○ | ○ | ○ | ○ | ○ | Δ |
| 8 | ○ | ○ | ○ | ○ | Δ | x | ○ | ○ | ○ | ○ | Δ | Δ |
| 9 | ○ | ○ | ○ | ○ | Δ | x | ○ | ○ | ○ | ○ | ○ | Δ |
| 10 | ○ | ○ | ○ | ○ | ○ | Δ | ○ | ○ | ○ | ○ | ○ | ○ |
| C36000 | ○ | ○ | ○ | ○ | Δ | Δ | ○ | ○ | ○ | ○ | ○ | Δ |

3. Cuttability

The test samples are prepared by casting and the same cutter, the cutting speed and the feeding amount are used. The cutter model: VCGT160404-AK H01, the rotational speed: 570 r/min, the feeding rate: 0.2 mm/r, the back engagement: 2 mm on one side. The universal dynamometer for broaching, hobbing, drilling and grinding developed by Beijing University of Aeronautics and Astronautics is used for measuring the cut resistance of C36000 and the brass alloys according to the invention. Calculate the relative cutting ratio and then the results are shown in table 4. The cutting morphologies for some alloys are shown in FIGS. 2-5.

4. Mechanical Properties

Alloys 1-4 are prepared by sand casting. Alloys 5-10 are semi-hard bars with a diameter of 29 mm, and machined into the test samples with a diameter of 10 mm for testing. The tensile test is performed under the room temperature. The comparative samples are C36000, which has the same temper and scale as alloys 1-10. The results are shown in Table 4.

5. Dezincification Test

The dezincification test is conducted according to GUT 10119-2008. The comparative sample is C36000, which is prepared by casting. The measured maximum dezincification depths are shown in table 4.

TABLE 4

| Dezincification corrosion resistance, mechanical properties and cuttability of the test samples | | | | | | | | | | | |
|---|---|---|---|---|---|---|---|---|---|---|---|
| Alloys | 1 | 2 | 3 | 4 | 5 | 6 | 7 | 8 | 9 | 10 | C36000 |
| Maximum depths of dezincification layer/μm | 380 | 356 | 396 | 340 | 384 | 347 | 322 | 345 | 402 | 425 | 613 |
| Tensile strength/MPa | 475 | 495 | 490 | 505 | 465 | 450 | 460 | 475 | 470 | 485 | 430 |
| Expansion ratio/% | 15 | 12 | 14 | 12.5 | 10 | 11.5 | 14 | 12.5 | 13 | 11 | 8.5 |
| Hardness/HRB | 62 | 65 | 69 | 73 | 62 | 60 | 58 | 64 | 64 | 68 | 45 |
| Cutting resistance/N | 434 | 427 | 420 | 419 | 412 | 408 | 429 | 440 | 435 | 426 | 381 |
| Relative cutting ratio/% | | >85 | | | | >90 | | | >85 | | 100 |

6. Metal Ions Release into Water

The release of the alloying elements for the test samples into water is measured according to NSF/ANSI 61-2007 standard. Varian 820-MS lcp. Mass Spectrometer (Inductively Coupled Plasma Mass Spectrometry) is used. The duration is 19 days. The test samples are ball valves prepared by sand casting or forging. The results are shown in table 5.

TABLE 5

NST results of the test samples

| Elements | Alloys 1 | 2 | 3 | 4 | 5 | 6 | 7 | 8 | 9 | 10 | C36000 | NSF 61 standard (μg/L) |
|---|---|---|---|---|---|---|---|---|---|---|---|---|
| Pb(μg/L) | 0.064 | 0.098 | 0.075 | 0.061 | 0.068 | 0.055 | 0.089 | 0.056 | 0.073 | 0.084 | 16.4 | ≤5.0 |
| Bi(μg/L) | 0.314 | 1.259 | 1.026 | 0.836 | 0.966 | 1.378 | 0.675 | 1.036 | 1.245 | 0.875 | 1.654 | ≤50.0 |
| Sb(μg/L) | 0.025 | 0.065 | 0.027 | 0.064 | 0.054 | 0.056 | 0.054 | 0.067 | 0.038 | 0.060 | 0.042 | ≤0.6 |
| Cu(μg/L) | 35.39 | 27.81 | 46.38 | 53.35 | 42.69 | 37.84 | 36.21 | 42.98 | 34.72 | 39.50 | 50.24 | ≤130.0 |
| Zn(μg/L) | 29.63 | 34.61 | 46.72 | 48.27 | 68.76 | 72.14 | 39.67 | 43.53 | 40.39 | 50.26 | 47.55 | ≤130.0 |
| Others | Qualified for Sn, As, Cd, Hg and Tl | | | | | | | | | | | |

It can be seen from the table above that the metal ions release for the alloys according to the present invention into water is much lower than that for C36000. The metal ions release of the alloys according to the invention into water meets NSF/ANSI Standard 61-2007-Drinking Water System Components. Therefore, the alloys according to the present invention are suitable for the accessories in the potable water supply systems.

7. Stress Corrosion Resistance

Testing materials: 1 inch ball valves including unassembled and assembled products (with a fastening torque of 90 N·m), wherein the assembled products include the unloading external pipes and the external pipes with a load torque of 120 N·m.

Testing conditions: 4% ammonia, 14% ammonia.

Duration: 12 h, 24 h, 48 h.

Determining method: Observing the surfaces fumed with ammonia at 15× magnification.

Comparative samples: C36000 and C87850.

After fumed with ammonia according to two standards, the test samples are taken out, and washed clean, the corrosion products on the surface of which are then rinsed with 5% sulfuric acid solution under the room temperature, and finally rinsed with water and blow-dried. The surfaces fumed with ammonia are observed at 15× magnification. If there is no obvious crack on the surface, it will be shown as "○", if there is fine crack on the surface, it will be shown as "Δ", and if there is obvious crack on the surface, it will be shown as "×".

TABLE 6

Stress corrosion resistance of the test samples

| Alloys | ISO 6957 (4% ammonia) Unassembled 24 h | Assembled products Unloaded 24 h | Assembled with a torque of 120 N · m 12 h | 24 h | 48 h | 14% ammonia Unassembled 24 h | Assembled products Unloaded 24 h | Assembled with a torque of 120 N · m 12 h | 24 h | 48 h |
|---|---|---|---|---|---|---|---|---|---|---|
| 1 | ○ | ○ | ○ | ○ | Δ | ○ | ○ | ○ | Δ | x |
| 2 | ○ | ○ | ○ | ○ | Δ | ○ | ○ | ○ | ○ | Δ |
| 3 | ○ | ○ | ○ | ○ | ○ | ○ | ○ | ○ | ○ | Δ |
| 4 | ○ | ○ | ○ | ○ | ○ | ○ | ○ | ○ | ○ | ○ |
| 5 | ○ | ○ | ○ | ○ | Δ | ○ | ○ | ○ | ○ | Δ |
| 6 | ○ | ○ | ○ | ○ | Δ | ○ | ○ | ○ | ○ | x |
| 7 | ○ | ○ | ○ | ○ | Δ | ○ | ○ | ○ | ○ | x |
| 8 | ○ | ○ | ○ | ○ | ○ | ○ | ○ | ○ | ○ | x |
| 9 | ○ | ○ | Δ | Δ | x | ○ | ○ | Δ | x | x |
| 10 | ○ | ○ | Δ | Δ | x | ○ | ○ | Δ | x | x |
| ZCuZn40Pb2 | ○ | ○ | ○ | ○ | Δ | ○ | ○ | Δ | Δ | x |
| C36000 | ○ | ○ | ○ | ○ | Δ | ○ | ○ | ○ | ○ | x |
| C87850 | ○ | ○ | ○ | ○ | Δ | ○ | ○ | ○ | Δ | x |

It can be seen from table 6 that there is no visible or obvious crack on the surfaces of the unassembled and assembled products for the brass alloys according to the present invention, ZCuZn40Pb2, C36000 and C87850 (having high copper and low zinc) after fuming with ammonia according to ISO 6957-1988. Furthermore, there is still no visible or obvious crack on the surface of the unassembled and assemble products for the brass alloys according to the present invention even if fuming with 14% ammonia for 24 hours. Thus it can be seen that the stress corrosion resistance of the brass alloys according to the present invention is be equivalent to that of C36000 and C87850, a little better than ZCuZn40Pb2, and significantly better than those alloys which only contains Fe or Mn.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A brass alloy having superior stress corrosion consisting of: 59.0-64.0wt % Cu, 0.6-1.2wt % Fe, 0.6-1.0wt % Mn, 0.5-0.8wt % Bi, 0.6-1.4wt % Sn, at least one element selected from Al, Cr and B, the balance being Zn and unavoidable impurities, wherein the content of Al is 0.1-0.8wt %, the content of Cr is 0.01-0.1wt %, the content of B is 0.001-0.02wt %.

2. The brass alloy according to claim 1, wherein the content of Fe in the brass alloy is 0.6-1.0wt %.

3. The brass alloy according to claim 2, wherein the content of Fe in the brass alloy is 0.7-0.9wt %.

4. The brass alloy according to claim 1, wherein the content of Mn in the brass alloy is 0.6-0.9 wt %.

5. The brass alloy according to claim 4, wherein the content of Mn in the brass alloy is 0.7-0.9wt %.

6. The brass alloy according to claim 1, wherein the content of Sn in the brass alloy is 0.8-1.4wt %.

7. The brass alloy according to claim 1, wherein the content of Al in the brass alloy is 0.3-0.8wt %.

8. The brass alloy according to claim 1, wherein the content of Cr is 0.01-0.03wt %.

9. The brass alloy according to claim 1, wherein the content of B is 0.001-0.005wt %.

10. A method for manufacturing the brass alloy according to claim 1, which comprises: batching, melting, pouring alloy ingots, remelting and sand casting, wherein the temperature for pouring alloy ingots is 990-1040° C. and the temperature for sand casting is 1000-1030° C.

11. A method for manufacturing the brass alloy according to claim 1, which comprises: batching, melting, horizontal continuous casting round ingots, flaying and hot forging, wherein the temperature for horizontal continuous casting round ingots is 990-1040° C. and the temperature for hot forging is 670-740° C.

12. A method for manufacturing the brass alloy according to claim 1, which comprises: batching, melting, horizontal continuous casting round ingots, extruding into bars and hot forging, wherein the temperature for horizontal continuous casting round ingots is 990-1040° C., the temperature for extruding into bars is 670-740° C. and the temperature for hot forging is 670-740° C.

* * * * *